US008328957B2

(12) United States Patent
Yokoyama et al.

(10) Patent No.: US 8,328,957 B2
(45) Date of Patent: Dec. 11, 2012

(54) ELECTRIC RESISTANCE WELDED STEEL PIPE WITH EXCELLENT WELD TOUGHNESS FOR LINE PIPE

(75) Inventors: Hiroyasu Yokoyama, Chita (JP); Kazuhito Kenmochi, Chiba (JP); Takatoshi Okabe, Chita (JP); Yukinori Iizuka, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 225 days.

(21) Appl. No.: 12/449,749

(22) PCT Filed: May 18, 2007

(86) PCT No.: PCT/JP2007/060656

§ 371 (c)(1),
(2), (4) Date: Aug. 25, 2009

(87) PCT Pub. No.: WO2008/105110

PCT Pub. Date: Sep. 4, 2008

(65) Prior Publication Data

US 2010/0032048 A1 Feb. 11, 2010

(30) Foreign Application Priority Data

Feb. 28, 2007 (JP) ..... 2007-048224

(51) Int. Cl.
*C22C 38/02* (2006.01)
*C22C 38/04* (2006.01)

(52) U.S. Cl. ..... 148/320; 148/332; 148/333; 148/334; 148/335; 148/336; 148/909; 148/519

(58) Field of Classification Search ..... 148/320, 148/526, 529, 519–521, 332–336, 909, 590, 148/591

See application file for complete search history.

(56) References Cited

U.S. PATENT DOCUMENTS

| | | | | |
|---|---|---|---|---|
| 4,079,224 | A * | 3/1978 | Haga et al. | 219/107 |
| 4,804,021 | A * | 2/1989 | Hasegawa et al. | 138/171 |
| 5,900,079 | A * | 5/1999 | Ono et al. | 148/519 |
| 6,406,564 | B1 * | 6/2002 | Muraki et al. | 148/333 |

FOREIGN PATENT DOCUMENTS

| | | | |
|---|---|---|---|
| EP | 1 325 967 | A1 | 7/2003 |
| JP | 2003-003233 | A | 1/2003 |
| JP | 2005-281838 | A | 10/2005 |

(Continued)

OTHER PUBLICATIONS

"Hagane no Kyoujinsei (Toughness of Steel)"; "Toward Improved Ductility and Toughness"; edited by Iron and Steel Institute of Japan and Japan Institute of Metals; published by Climax Molybdenum Development Company (Japan) Ltd; 1971, pp. 207-208 (English language).

(Continued)

*Primary Examiner* — Deborah Yee
(74) *Attorney, Agent, or Firm* — Holtz, Holtz, Goodman & Chick, PC

(57) ABSTRACT

In an electric resistance welded steel pipe with excellent weld toughness for a line pipe, the area fraction of minute defects each having a maximum length of less than 50 μm in a projection plane of an electric resistance welded seam is in the range of 0.000006 to 0.026, and the absorbed energy at −40° C. measured by a method for an impact test of metallic materials is 315 J or more.

18 Claims, 2 Drawing Sheets

FOREIGN PATENT DOCUMENTS

| | | | |
|---|---|---|---|
| JP | 2007-000874 | A | 1/2007 |
| WO | WO 2006/086853 | A1 | 8/2006 |

OTHER PUBLICATIONS

Court S A et al, "Inclusion chemistry and morphology in shielded metal arc (SMA) steel weld deposits", Metallography, American Elsevier, New York, NY, USA, vol. 22, No. 3, May 1, 1989, pp. 219-243.

Fazzini P G et al, "Experimental validation of the influence of lamination defects in electrical resistance seam welded pipelines", International Journal of Pressure Vessels and Piping, Elsevier Science Publishers, Barking, GB, vol. 82, No. 12, Dec. 1, 2005, pp. 896-904.

MacDonald K A et al, "Best practice for the assessment of defects in pipelines—gouges and dents", Engineering Failure Analysis, Pergamon, GB, vol. 12, No. 5, Oct. 1, 2005, pp. 720-745.

The Extended Search Report which includes the Supplementary European Search Report and the European Search Opinion in EP 07 74 4090 dated Jun. 28, 2011.

* cited by examiner

ELECTRIC RESISTANCE WELDED STEEL PIPE WITH EXCELLENT WELD TOUGHNESS FOR LINE PIPE

This application is the United States national phase application of International Application PCT/JP2007/060656 filed May 18, 2007.

TECHNICAL FIELD

The present invention relates to electric resistance welded steel pipes with excellent weld toughness, in particular, to an electric resistance welded steel pipe with excellent weld toughness for a line pipe, the toughness being improved by focusing attention on minute defects (minute oxides and inclusions) that govern weld toughness and specifying the area fraction of the minute defects in the welds.

BACKGROUND ART

A reduction in the toughness, in particular, impact absorption energy of steel products as the number of non-metal inclusions in steel is increased has often been investigated. For example, Non-Patent Document 1 describes MnS. In the case of carbides, Non-Patent Document 2 describes the effect of primary carbides in tool steel. The relationship between the non-metal inclusions and the impact absorption energy is generalized by regarding the non-metal inclusions as vacancy-type defects and is studied as the relationship between the defect size in steel and the impact properties. It appears that the impact properties are reduced as the size of the inclusions is increased.

Meanwhile, with respect to electric resistance welded seams, oxides referred to as "penetrators", specifically, minute inclusions (in the form of an ellipse with a longitudinal diameter of 0.2 to 0.5 mm) present in welding faces by electric resistance welding, have been reported (Non-Patent Document 3). In general, impact properties of electric resistance welded seams have been said to be poor because of the presence of such penetrators. For the purpose of improving impact properties of electric resistance welded seams, there have been advances in a technique for reducing such penetrators. For example, heat input control relying on experience has been performed.

Disadvantageously, just reducing penetrators, which has been reported, does not necessarily improve impact properties.

Non-Patent Document 1: "Tekkou to Goukin Genso (ge) (Steel and Alloy Element II)", 1st ed.; edited by the 19th Committee for Steelmaking, Japan Society for Promotion of Science; published by Seibundo Shinkosha Inc.; 25 Mar. 1966, pp. 165-274 (in particular, pp 191-208).

Non-Patent Document 2: "Hagane no Kyoujinsei (Toughness of Steel)"; edited by Iron and Steel Institute of Japan and Japan Institute of Metals; published by Climax Molybdenum Development Company (Japan) Ltd.; 1971, p 207.

Non-Patent Document 3: "Chouonpa Tanshou Series II, Yousetsu Koukan no Chouonpa Tanshou (Ultrasonic Testing Series II, Ultrasonic Testing for Flaw Detection of Welded Steel Pipe)"; edited by Iron and Steel Institute of Japan; published by Iron and Steel Institute of Japan; 1988, p 28-31.

DISCLOSURE OF INVENTION

In consideration of the foregoing circumstances, it is an object of the present invention to provide an electric resistance welded steel pipe for a line pipe, the electric resistance welded steel pipe having a high-toughness weld seam such that an electric resistance welded seam does not undergo brittle fracture.

The present invention that achieves the object will be described below.

1. In an electric resistance welded steel pipe with excellent weld toughness for a line pipe, the area fraction of minute defects each having a maximum length of less than 50 μm in a projection plane of an electric resistance welded seam is in the range of 0.000006 to 0.035, a V notch is formed on the electric resistance welded seam of a specimen for an impact test for metallic materials (V-notch Charpy test specimen) according to ISO/DIS 148-1 (JIS Z 2202), and the absorbed energy at −40° C. of the specimen measured by a method for impact test for metallic materials according to ISO 148 (JIS Z 2242) is 100 J or more.
2. The electric resistance welded steel pipe with excellent weld toughness for a line pipe described in item 1 contains, on a percent by mass basis, 0.01% to 0.15% C, 0.005% to 0.9% Si, 0.2% to 2.0% Mn, 0.01% or less P, 0.01% or less S, 0.1% or less Al, and the balance being substantially Fe.
3. The electric resistance welded steel pipe with excellent weld toughness for a line pipe described in item 2 further contains, on a percent by mass basis, one or two selected from 0.5% or less Cu and 0.5% or less Ni.
4. The electric resistance welded steel pipe with excellent weld toughness for a line pipe described in item 2 or 3, further contains, on a percent by mass basis, one or two selected from 3.0% or less Cr and 2.0% or less Mo.
5. The electric resistance welded steel pipe with excellent weld toughness for a line pipe described in any one of items 2 to 4, further contains, on a percent by mass basis, one or two or more selected from 0.1% or less Nb, 0.1% or less V, and 0.1% or less Ti.
6. The electric resistance welded steel pipe with excellent weld toughness for a line pipe described in any one of items 2 to 5, further contains, on a percent by mass basis, 0.005% or less Ca.
7. The electric resistance welded steel pipe with excellent weld toughness for a line pipe described in any one of items 1 to 6, in which the minute defects are composed of one or two or more selected from oxides, nitrides, and carbides remaining in a weld face when electric resistance welding is performed.

Advantages

According to the present invention, specifying the area fraction of minute defects in a welded seam results in an electric resistance welded steel pipe with excellent weld toughness.

Figure 1:
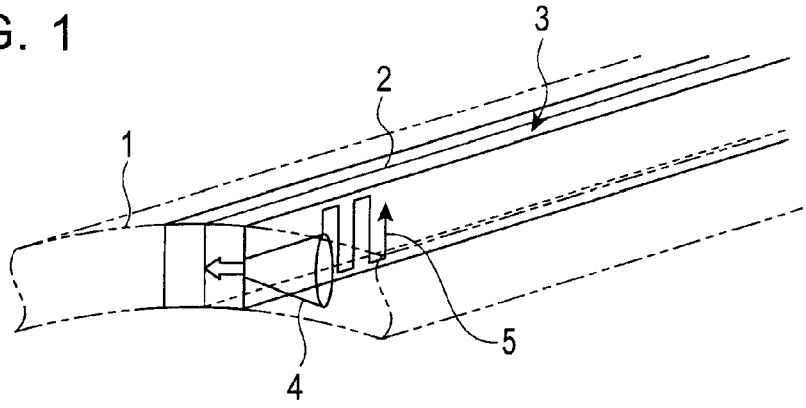
FIG. 1 is a schematic diagram illustrating a C scan method.

Reference numerals in the drawings are as follows:

1: electric resistance welded steel pipe, 2: seam, 3: sample, 4: convergence-type ultrasound probe, 5: scanning direction, and 6: array-type probe.

BEST MODES FOR CARRYING OUT THE INVENTION

From the viewpoint of inhibiting the brittle fracture of an electric resistance welded steel pipe for a line pipe with strength equal to or higher than that specified by the API X60 grade, the inventors have conducted studies on the distribution morphology of minute defects in a welded seam and a component system to achieve the toughness of the welded seam required and have found that the welded seam preferably has high toughness such that the absorbed energy at −40° C. measured by a V-notch Charpy impact test is 100 J or more and that the high toughness is achieved by optimizing the area fraction of minute defects having a maximum length of less than 50 μm in the projection plane of the electric resistance welded seam and optimizing the chemical components (composition). Note that "the projection plane of the electric resistance welded seam" is used to indicate a plane when the region of a seam 2 shown in FIG. 1 is observed from the direction perpendicular to the seam face.

The area fraction of minute defects in the electric resistance welded seam and the chemical components of the electric resistance welded steel pipe according to the present invention will be described below.

The inventors have conducted intensive studies and have found that the amount of minute defects remaining in a weld seam of an electric resistance welded steel pipe participated in the toughness of the weld seam. As described above, penetrators in an electric resistance welded seam have been defined as oxides remaining on a welding face, each of the oxides being in the form of an eclipse having a size of 0.2 to 0.5 mm. The term "minute defects" in the present invention is used to indicate not defects having such a size but oxides, nitrides, or carbides having a maximum length of less than 50 μm.

The inventors have determined the relationship between the morphology of the minute defects and the toughness by an experiment using a seam-sliced-material C-scan method (abbreviated as C-scan method).

In this experiment, as shown in FIG. 1, a weld sample 3 was first obtained by slicing the electric resistance welded steel pipe 1 at positions apart from the seam 2 of an electric resistance welded steel pipe 1 by a predetermined distance (in this case, 8 mm). To detect defects, the seam of the sample 3 was subjected to a C scan (along a scanning direction 5) with a convergence-type ultrasonic probe 4, and the signal intensity was measured.

Figure 2:
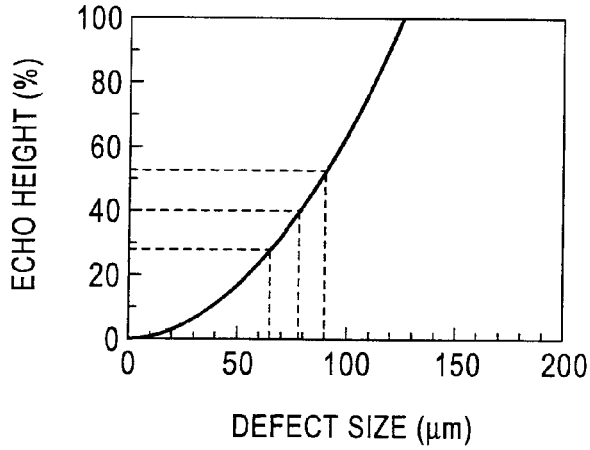
FIG. 2 is a graph showing an exemplary relationship between the signal intensity and the defect size.

Here, welding conditions of the electric resistance welded steel pipe as an experimental material include the normal condition of electric resistance welding; and the condition that the welding heat input and the upset value are adjusted so as to minimize the amount of minute defects. Various welding conditions were used. The convergence-type ultrasonic probe had a frequency of 20 MHz and a beam diameter of 440 μm. Flaw detection was performed after the sensitivity was adjusted in such a manner that the echo height from a flat-bottomed hole having a diameter of 125 μm was 100%. The relationship between the signal intensity (echo height) and the defect size at the sensitivity setting is shown in FIG. 2. The term "defect size" is used to indicate a defect size (equivalent defect size) corresponding to the sum of the areas of minute defects each having a maximum length of less than 50 μm in the beam.

Figure 3:
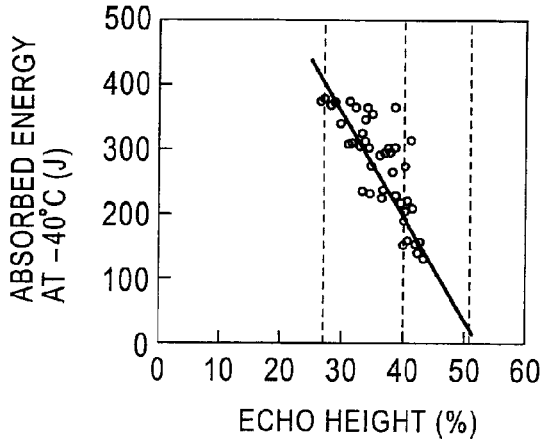
FIG. 3 is a graph showing an exemplary relationship between the signal intensity and the absorbed energy at −40° C.

A Charpy specimen was taken from the C-scanned portion and subjected to the Charpy test to measure absorbed energy at −40° C. (abbreviated as "−40° C. absorbed energy"), determining the relationship between the absorbed energy and the signal intensity. FIG. 3 shows the results.

FIG. 3 shows that the echo height measured by the C scan correlates with the −40° C. absorbed energy. When the echo heights were 27% or less, 40% or less, and 51% or less, the −40° C. absorbed energy were 400 J or more, 200 J or more, and 20 J or more, respectively. Meanwhile, from FIG. 2, the echo heights of 27%, 40%, and 51% correspond to the presence of defects with a diameter of 63 μm, 73 μm, and 90 μm, respectively. In view of a beam diameter of 440 μm, the minute defect densities at the −40° C. absorbed energy levels are shown in Table 1.

TABLE 1

| Absorbed energy at −40° C. | Echo height | Equivalent defect size | Equivalent defect area | Beam diameter Beam area | Minute defect density (per $mm^2$) |
|---|---|---|---|---|---|
| 400 J | 27% | 63 μm | 3117 $\mu m^2$ | 440 μm | 0.0205 $mm^2$ |
| 200 J | 40% | 78 μm | 4778 $\mu m^2$ | 0.152 $mm^2$ | 0.0314 $mm^2$ |
| 20 J | 51% | 90 μm | 6362 $\mu m^2$ | | 0.0418 $mm^2$ |

Figure 4:
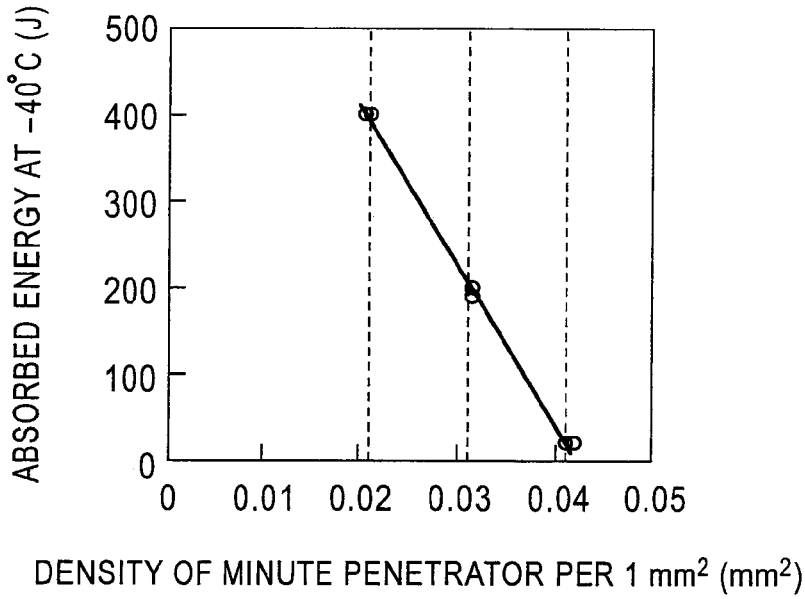
FIG. 4 is a graph showing an exemplary relationship between the area fraction of minute defects in a weld seam and the absorbed energy at −40° C.

FIG. 4 summarizes the experimental results. The results demonstrate that in the case where the minute defect density is 0.035 $mm^2$ or less per 1 $mm^2$ (i.e., the area fraction of minute defects is 0.035 or less), a −40° C. absorbed energy of 100 J or more is obtained.

The lower limit of the area fraction of minute defects was set to 0.000006 (0.000006 $mm^2$ per 1 $mm^2$) on the basis of the minimum density of oxides contained in industrially produced cleanliness steel.

Figure 5:
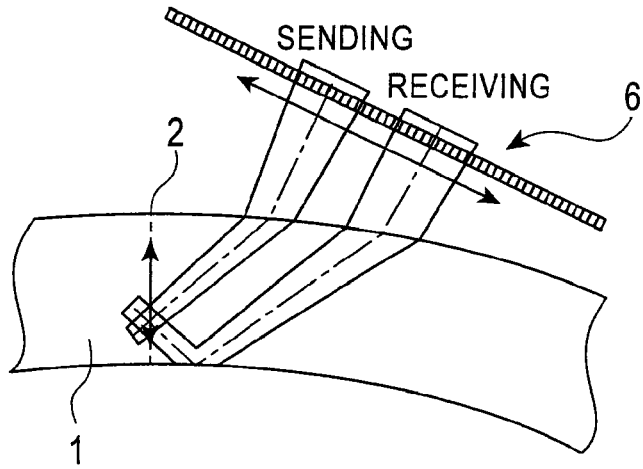
FIG. 5 is a schematic diagram illustrating array ultrasonic testing (array UT) of a weld seam using an array-type probe.

The results of the investigation of the sliced seam sample by the C scan have been described above. Similar measurement of a steel pipe without processing can also be made by tandem inspection with a beam converging to an appropriate area. To allow the beam to converge, the same convergence-type ultrasound probe as that used in the C-scan may be used. Alternatively, for example, as shown in FIG. 5, an array-type probe 6 arranged in the circumferential direction may be used. In this case, an excessively small size of a beam results in difficulty in evaluating the area fraction of minute defects. An excessively large size of the beam leads to increased susceptibility to noise from internal and external surfaces of the pipe. Thus, the beam suitably has a diameter of 0.5 to 2.5 mm. In FIG. 5, the seam can be readily scanned in the thickness direction by electronically switching the positions of sending and receiving oscillators.

To achieve an area fraction of minute defects in the weld seam of 0.035 or less, the heat input control during electric resistance welding is necessary, but it is effective to perform the forming processing of edges of a plate in the width direction by, for example, proper cutting or rolling (preferably, fin-pass forming) before bending in the width direction by roll forming or in the course of the bending in such a manner that edge faces to be butted immediately before electric resistance welding each have a groove shape with a parallel facing portion located in the central region in the thickness direction and angled facing portions located on both sides of the parallel facing portion.

Preferred chemical components (composition) of the electric resistance welded steel pipe of the present invention will be described below. The composition of the electric resistance welded steel pipe is determined in view of a reduction in total cost when the pipe is laid. In particular, the composition is determined in view of requests by customers who place importance on a reduction in the transportation cost of steel pipes. Thus, a preferred composition range is specified in such a manner that a high strength equal to or higher than that specified by the API X60 grade is achieved. Note that the units of component contents in the composition are percent by mass and are simply indicated by %.

C: The C content is set in the range of 0.01% to 0.15%. C is an element that is precipitated as carbide and contributes to an increase in strength. A C content of less than 0.02% does not ensure sufficient strength. A C content exceeding 0.15% results in an increase in the fraction of a second phase, e.g., pearlite, bainite, or martensite, leading to difficulty in ensuring material toughness required for a line pipe. Thus, the C content is set to 0.15% or less and preferably 0.07% or less. A C content of less than 0.01% results in difficulty in ensuring strength sufficient for a line pipe. Thus, the C content is preferably set to 0.01% or more.

Si: The Si content is set in the range of 0.005% to 0.9%. Si is added for deoxidation purposes. A Si content of less than 0.005% does not result in a sufficient deoxidation effect. A Si content exceeding 0.9% results in an increase in the number of oxides in the electric resistance welded seam, reducing the properties of the weld seam. Thus, the Si content is set in the range of 0.005% to 0.9%.

Mn: The Mn content is in the range of 0.2% to 2.0%. Mn is added to ensure strength and toughness. A Mn content of less than 0.2% does not result in a sufficient effect. A Mn content exceeding 2.0% results in an increase in the fraction of the second phase, leading to difficulty in ensuring excellent material toughness required for a line pipe. Thus, the Mn content is set in the range of 0.2% to 2.0%.

P: The P content is set to 0.01% or less. P is an incidental impurity that reduces weldability by electric resistance welding. Thus, the upper limit is set to 0.01%.

S: The S content is set to 0.01% or less. In general, S forms MnS inclusions in steel and acts as a starting point of hydrogen-induced cracking (HIC). Thus, the S content is preferably minimized. However, a S content of 0.01% or less does not cause a problem. Thus, the upper limit of the S content is set to 0.01%.

Al: The Al content is set to 0.1% or less. Al is added as a deoxidizer. An Al content exceeding 0.1% results in a reduction in the cleanliness of steel, reducing the toughness. Thus, the Al content is set to 0.1% or less.

In the present invention, to further improve the strength, yield ratio, and toughness of the electric resistance welded steel pipe for a line pipe, in addition to the foregoing components, the electric resistance welded steel pipe may further contain one or two elements selected from Cu (0.5% or less) and Ni (0.5% or less), one or two elements selected from Cr (3.0% or less) and Mo (2.0% or less), one or two or more elements selected from Nb (0.1% or less), V (0.1% or less), and Ti (0.1% or less), and Ca (0.005% or less).

Cu: The Cu content is set to 0.5% or less. Cu is an element effective in improving toughness and increasing strength. The addition of a large amount of Cu reduces the weldability. Thus, in the case of adding Cu, the upper limit of the Cu content is set to 0.5%.

Ni: The Ni content is set to 0.5% or less. Ni is an element effective in improving toughness and increasing strength. The addition of a large amount of Ni facilitates the formation of the hard second phase, leading to a reduction in the toughness of the material. Thus, in the case of adding Ni, the upper limit of the Ni content is set to 0.5%.

Cr: The Cr content is set to 3.0% or less. Like Mn, Cr is an element effective in providing a sufficient strength even at a low C content. The addition of a large amount of Cr facilitates the formation of the second phase, reducing the toughness of the material. Thus, in the case of adding Cr, the upper limit of the Cr content is set to 3.0%.

Mo: The Mo content is set to 2.0% or less. Like Mn and Cr, Mo is an element effective in providing a sufficient strength even at a low C content. The addition of a large amount of Mo facilitates the formation of the second phase, reducing the toughness of the material. Thus, in the case of adding Mo, the upper limit of the Mo content is set to 2.0%.

Nb: The Nb content is set to 0.1% or less. Nb improves strength and toughness by the fine precipitation of a carbonitride and the formation of finer grains in the structure. However, at a Nb content exceeding 0.1%, the hard second phase is readily increased, significantly reducing the toughness of the material. Thus, the Nb content is set to 0.1% or less.

V: The V content is set to 0.1% or less. Like Nb, V contributes to an increase in strength by the fine precipitation of a carbonitride. However, at a V content exceeding 0.1%, like Nb, the hard second phase is increased, significantly reducing the toughness of the material. Thus, the V content is set to 0.1% or less.

Ti: The Ti content is set to 0.1% or less. Like Nb and V, Ti contributes to an increase in strength by the fine precipitation of a carbonitride. However, at a Ti content exceeding 0.1%, like Nb, the hard second phase is increased, significantly reducing the toughness of the material. Thus, the Ti content is set to 0.1% or less.

Ca: The Ca content is set to 0.005% or less. Ca is an element needed to control the morphology of extended MnS that tends to act as a starting point of hydrogen-induced cracking. However, a Ca content exceeding 0.005% results in the formation of an excess of oxides and sulfides of Ca, leading to a reduction in toughness. Thus, the Ca content is set to 0.005% or less.

The balance other than the foregoing components is substantially Fe. The fact that the balance is substantially Fe indicates that steel containing incidental impurities and other trace elements may be included in the present invention unless the effect of the present invention is eliminated.

EXAMPLES

Steel samples (steel samples 1 to 10) having plate thicknesses and chemical compositions shown in Table 2 were used. Electric resistance welding was performed under two conditions: a conventional electric resistance welding condition (condition A) and an electric resistance welding condition (condition B) in which the processing of inner and outer surface side portions of edges by fin-pass forming before electric resistance welding in such a manner that the edges have groove shapes makes it difficult to allow minute defects to remain in the weld seam, thereby producing an X65-grade electric resistance welded steel pipe with an external diameter of 20 inches.

TABLE 2

| Steel sample | Chemical composition (mass %) C | Si | Mn | P | S | Al | Cu | Ni | Cr | Mo | Nb | V | Ti | Ca | Plate thickness (mm) | Preferred composition range |
|---|---|---|---|---|---|---|---|---|---|---|---|---|---|---|---|---|
| 1 | 0.19 | 0.55 | 1.55 | 0.006 | 0.015 | 0.024 | — | — | — | — | — | — | — | — | 12.7 | Outside |
| 2 | 0.08 | 0.25 | 2.51 | 0.008 | 0.006 | 0.015 | — | 0.44 | 0.48 | — | 0.006 | — | 0.005 | 0.002 | 11.3 | Outside |
| 3 | 0.07 | 0.21 | 1.37 | 0.007 | 0.005 | 0.021 | 0.15 | 0.13 | 0.15 | 0.03 | 0.17 | — | 0.007 | 0.003 | 15.9 | Outside |
| 4 | 0.02 | 0.19 | 1.08 | 0.003 | 0.004 | 0.022 | 0.21 | 0.22 | 0.35 | 0.11 | 0.04 | 0.05 | 0.003 | 0.005 | 19.1 | Inside |
| 5 | 0.06 | 0.23 | 1.45 | 0.004 | 0.003 | 0.018 | 0.28 | 0.18 | 0.25 | 0.05 | 0.03 | — | 0.006 | 0.003 | 20.6 | Inside |
| 6 | 0.01 | 0.19 | 1.07 | 0.006 | 0.002 | 0.015 | — | — | 0.35 | — | — | — | 0.003 | 0.003 | 15.9 | Inside |
| 7 | 0.04 | 0.21 | 1.21 | 0.005 | 0.003 | 0.027 | 0.22 | 0.11 | — | — | — | 0.04 | — | 0.003 | 17.3 | Inside |
| 8 | 0.05 | 0.18 | 1.32 | 0.005 | 0.004 | 0.033 | — | — | 0.41 | 0.11 | — | — | — | 0.005 | 12.7 | Inside |
| 9 | 0.03 | 0.21 | 0.95 | 0.004 | 0.003 | 0.021 | — | — | — | — | 0.04 | 0.06 | 0.006 | 0.003 | 11.3 | Inside |
| 10 | 0.16 | 0.55 | 1.55 | 0.006 | 0.004 | 0.024 | — | — | — | — | — | — | — | — | 12.7 | Outside |

Any of the steel samples were subjected to hot rolling to have a predetermined thickness and then coiled to form a hot-rolled coil. Table 3 shows the toughness of the base material, the toughness of the weld seam, and the area fraction of minute defects in the weld seam. With respect to the toughness of the base material, ten JIS No. 5 2-mm V-notch Charpy impact test specimens were taken from a position 180° apart from the electric resistance welded seam of each steel sample in the circumferential direction. With respect to the toughness of the weld seam, ten JIS No. 5 2-mm V-notch Charpy impact test specimens were taken from the electric resistance welded seam of each steel sample. Then −40° C. absorbed energy was measured. In view of manufacturing variations, evaluation criteria were as follows.

Excellent: The −40° C. absorbed energy of the weld seam is 125 J or more. In this case, target properties are sufficiently satisfied.

Acceptable: The −40° C. absorbed energy of the weld seam is 100 J or more and less than 125 J. In this case, the target properties are not sufficiently satisfied but are satisfied at an acceptable level.

The area fraction of minute defects in the weld seam was measured by array ultrasonic testing shown in FIG. 5.

In steel sample 1 in which the C and S contents were greatly outside the preferred range, the structure was a ferrite-bainite system. The base material had low toughness. Also in the case of any of the electric resistance welding conditions A and B, the weld seam had low toughness. In steel samples 2 and 3 in which the Mn or Nb content was greatly outside the preferred range, the base material had sufficient toughness. In the case of any of the welding conditions, however, the toughness of the weld seam was low and did not satisfy a −40° C. absorbed energy of 100 J or more. In steel samples 4 to 9 in which the compositions were inside the preferred range, in the case of the conventional electric resistance welding (condition A), there were specimens having an area fraction of minute defects in the weld seam exceeding 0.035 and a −40° C. absorbed energy of less than 100 J. In contrast, in the case of the electric resistance welding (condition B) that made it difficult to allow minute defects to remain, in each specimen, the area fraction of minute defects in the weld seam was 0.035 or less, and high −40° C. absorbed energy was stably exhibited. In steel sample 10 in which the C content was slightly outside the preferred range, in the case of the electric resistance welding under the condition B, the area fraction of minute defects in the weld seam was 0.035 or less, and the −40° C. absorbed energy of the weld seam was 100 J or more and less than 125 J.

TABLE 3

| No. | Steel sample | Welding condition | −40° C. absorbed energy (J) | Minimum | Mean | Evaluation | Maximum | Evaluation | Comprehensive evaluation | Remark |
|---|---|---|---|---|---|---|---|---|---|---|
| 1 | 1 | A | 110 | 10 | 55 | Poor | 0.045 | Poor | Poor | Comparative Example |
| 2 | 1 | B | 110 | 35 | 60 | Poor | 0.042 | Poor | Poor | Comparative Example |
| 3 | 2 | A | 350 | 21 | 50 | Poor | 0.043 | Poor | Poor | Comparative Example |
| 4 | 2 | B | 352 | 55 | 65 | Poor | 0.038 | Poor | Poor | Comparative Example |
| 5 | 3 | A | 375 | 15 | 65 | Poor | 0.045 | Poor | Poor | Comparative Example |
| 6 | 3 | B | 377 | 74 | 85 | Poor | 0.039 | Poor | Poor | Comparative Example |
| 7 | 4 | A | 385 | 50 | 55 | Poor | 0.042 | Poor | Poor | Comparative Example |
| 8 | 4 | B | 387 | 325 | 362 | Excellent | 0.028 | Excellent | Excellent | Example |
| 9 | 5 | A | 386 | 55 | 62 | Poor | 0.041 | Poor | Poor | Comparative Example |
| 10 | 5 | B | 384 | 332 | 367 | Excellent | 0.025 | Excellent | Excellent | Example |
| 11 | 6 | A | 394 | 70 | 73 | Poor | 0.040 | Poor | Poor | Comparative Example |
| 12 | 6 | B | 392 | 315 | 352 | Excellent | 0.026 | Excellent | Excellent | Example |
| 13 | 7 | A | 378 | 75 | 85 | Poor | 0.039 | Poor | Poor | Comparative Example |
| 14 | 7 | B | 376 | 342 | 359 | Excellent | 0.024 | Excellent | Excellent | Example |
| 15 | 8 | A | 394 | 93 | 120 | Poor | 0.037 | Poor | Poor | Comparative Example |
| 16 | 8 | B | 392 | 371 | 385 | Excellent | 0.023 | Excellent | Excellent | Example |
| 17 | 9 | A | 395 | 85 | 105 | Poor | 0.037 | Poor | Poor | Comparative Example |
| 18 | 9 | B | 396 | 387 | 390 | Excellent | 0.021 | Excellent | Excellent | Example |
| 19 | 10 | A | 255 | 20 | 63 | Poor | 0.041 | Poor | Poor | Comparative Example |
| 20 | 10 | B | 261 | 105 | 120 | Acceptable | 0.033 | Excellent | Acceptable | Example |

The invention claimed is:

1. An electric resistance welded steel pipe with excellent weld toughness for a line pipe, wherein said steel pipe comprises on a percent by mass basis, 0.01% to 0.15% C, 0.005% to 0.9% Si, 0.2% to 2.0% Mn, 0.01% or less P, 0.01% or less S, 0.1% or less Al, and the balance being substantially Fe and wherein the area fraction of minute defects each having a maximum length of less than 50 μm in a projection plane of an electric resistance welded seam is in the range of 0.000006 to 0.026, a V notch is formed on the electric resistance welded seam of a specimen for an impact test for metallic materials (V-notch Charpy test specimen) according to ISO/DIS 148-1 (JIS Z 2202), and the absorbed energy at −40° C. of the specimen measured by a method for impact test for metallic materials according to ISO 148 (JIS Z 2242) is 315 J or more.

2. The electric resistance welded steel pipe with excellent weld toughness for a line pipe according to claim 1, further comprising, on a percent by mass basis, one or two selected from 0.5% or less Cu and 0.5% or less Ni.

3. The electric resistance welded steel pipe with excellent weld toughness for a line pipe according to claim 1, further comprising, on a percent by mass basis, one or two selected from 3.0% or less Cr and 2.0% or less Mo.

4. The electric resistance welded steel pipe with excellent weld toughness for a line pipe according to claim 1, further comprising, on a percent by mass basis, one or two or more selected from 0.1% or less Nb, 0.1% or less V, and 0.1% or less Ti.

5. The electric resistance welded steel pipe with excellent weld toughness for a line pipe according to claim 1, further comprising, on a percent by mass basis, 0.005% or less Ca.

6. The electric resistance welded steel pipe with excellent weld toughness for a line pipe according to claim 1, wherein the minute defects are composed of one or two or more selected from oxides, nitrides, and carbides remaining in a weld face when electric resistance welding is performed.

7. The electric resistance welded steel pipe with excellent weld toughness for a line pipe according to claim 2, further comprising, on a percent by mass basis, one or two selected from 3.0% or less Cr and 2.0% or less Mo.

8. The electric resistance welded steel pipe with excellent weld toughness for a line pipe according to claim 2, further comprising, on a percent by mass basis, one or two or more selected from 0.1% or less Nb, 0.1% or less V, and 0.1% or less Ti.

9. The electric resistance welded steel pipe with excellent weld toughness for a line pipe according to claim 3, further comprising, on a percent by mass basis, one or two or more selected from 0.1% or less Nb, 0.1% or less V, and 0.1% or less Ti.

10. The electric resistance welded steel pipe with excellent weld toughness for a line pipe according to claim 7, further comprising, on a percent by mass basis, one or two or more selected from 0.1% or less Nb, 0.1% or less V, and 0.1% or less Ti.

11. The electric resistance welded steel pipe with excellent weld toughness for a line pipe according to claim 2, further comprising, on a percent by mass basis, 0.005% or less Ca.

12. The electric resistance welded steel pipe with excellent weld toughness for a line pipe according to claim 2, further comprising, on a percent by mass basis, 0.005% or less Ca.

13. The electric resistance welded steel pipe with excellent weld toughness for a line pipe according to claim 4, further comprising, on a percent by mass basis, 0.005% or less Ca.

14. The electric resistance welded steel pipe with excellent weld toughness for a line pipe according to claim 7, further comprising, on a percent by mass basis, 0.005% or less Ca.

15. The electric resistance welded steel pipe with excellent weld toughness for a line pipe according to claim 8, further comprising, on a percent by mass basis, 0.005% or less Ca.

16. The electric resistance welded steel pipe with excellent weld toughness for a line pipe according to claim 9, further comprising, on a percent by mass basis, 0.005% or less Ca.

17. The electric resistance welded steel pipe with excellent weld toughness for a line pipe according to claim 10, further comprising, on a percent by mass basis, 0.005% or less Ca.

18. The electric resistance welded steel pipe with excellent weld toughness for a line pipe according to claim 2, wherein the minute defects are composed of one or two or more selected from oxides, nitrides, and carbides remaining in a weld face when electric resistance welding is performed.

* * * * *